US010128039B2

(12) United States Patent
Wada

(10) Patent No.: US 10,128,039 B2
(45) Date of Patent: Nov. 13, 2018

(54) COIL COMPONENT

(71) Applicant: MURATA MANUFACTURING CO., LTD., Kyoto-fu (JP)

(72) Inventor: Tomoyuki Wada, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/883,765

(22) Filed: Oct. 15, 2015

(65) Prior Publication Data

US 2016/0118183 A1 Apr. 28, 2016

(30) Foreign Application Priority Data

Oct. 28, 2014 (JP) ..... 2014-219431

(51) Int. Cl.

| | |
|---|---|
| ***H01F 27/29*** | (2006.01) |
| ***H01F 17/04*** | (2006.01) |
| ***H01F 27/28*** | (2006.01) |
| ***H01F 27/24*** | (2006.01) |

(52) U.S. Cl.

CPC ..... *H01F 27/292* (2013.01); *H01F 17/045* (2013.01); *H01F 27/2823* (2013.01)

(58) Field of Classification Search

CPC ..... H01F 17/045

See application file for complete search history.

(56) References Cited

U.S. PATENT DOCUMENTS

| | | | | |
|---|---|---|---|---|
| 7,212,093 | B2 * | 5/2007 | Singu | H01F 27/292 336/83 |
| 2007/0063804 | A1 * | 3/2007 | Watanabe | H01F 3/10 336/83 |
| 2010/0090790 | A1 * | 4/2010 | Azuma | H01F 17/04 336/192 |
| 2010/0109827 | A1 * | 5/2010 | Asou | H01F 17/045 336/192 |

FOREIGN PATENT DOCUMENTS

| | | |
|---|---|---|
| JP | H10-189343 A | 7/1998 |
| JP | 2011-253888 A | 12/2011 |

OTHER PUBLICATIONS

Permeability(electromagnetism).*
English translation of JP10189343.*
An Office Action; "Notice of Reasons for Rejection," issued by the Japanese Patent Office dated Apr. 4, 2017, which corresponds to Japanese Patent Application No. 2014-219431 and is related to U.S. Appl. No. 14/883,765; with English language translation.
An Office Action; "Notice of Reasons for Rejection," issued by the Japanese Patent Office dated Nov. 21, 2017, which corresponds to Japanese Patent Application No. 2014-219431 and is related to U.S. Appl. No. 14/883,765.

* cited by examiner

*Primary Examiner* — Ronald Hinson
(74) *Attorney, Agent, or Firm* — Studebaker & Brackett PC

(57) ABSTRACT

A core of a coil component is formed of a first flange, a second flange, and a winding core connecting the first flange and the second flange to each other. A winding is wound (Continued)

around the winding core. The core is formed of a first part and a second part, the second part having a smaller magnetic permeability and a higher rigidity than the first part. The second part is formed of an end portion of the first flange on one side in an extension direction of the first flange and an end portion of the second flange on one side in an extension direction of the second flange.

8 Claims, 5 Drawing Sheets

COIL COMPONENT

CROSS REFERENCE TO RELATED APPLICATIONS

This application claims benefit of priority to Japanese Patent Application No. 2014-219431 filed Oct. 28, 2014, the entire content of which is incorporated herein by reference.

TECHNICAL FIELD

The present disclosure relates to a coil component.

BACKGROUND

An example of a coil component of the related art is described in Japanese Unexamined Patent Application Publication No. 2011-253888. The coil component includes a core and a winding, and the core is composed of a single body and is composed of the same magnetic material throughout. The core includes a pair of flanges and a winding core. The winding core connects one flange and the other flange to each other. The winding is composed of a copper wire coated with an insulating coating film. The winding is wound around the winding core.

The inventor of the present application found the following issue with the coil component of the related art. Since the core of the coil component of the related art is composed of a single magnetic material and the strength of the core does not vary depending on the location, damage may occur in parts of the core where stress concentrates.

In particular, stress is likely to concentrate around the flanges and a base portion of the winding core, and more specifically, stress is likely to concentrate in portions of the flanges where electrodes are formed, that is, on distal parts of end portions of the flanges on the mounting surface side of the flanges. Therefore, damage is likely to occur in such portions.

In particular, in recent years, in order to increase the frequency and speed of logic circuits and to conserve resources and electrical power, coil components have been becoming progressively smaller in size. Therefore, the strength of cores has decreased with the reduction in size of the cores and the issue of damage has become significant.

SUMMARY

Accordingly, an issue addressed by the present disclosure is to provide a coil component in which the core is unlikely to be damaged.

In order to address the above-described issue, a coil component according to a preferred embodiment of the present disclosure includes a core including a first flange, a second flange and a winding core connecting the first flange and the second flange to each other; a winding wound around the winding core; a first electrode provided on the first flange and electrically connected to one end of the winding; and a second electrode provided on the second flange and electrically connected to another end of the winding. The core includes a first part including at least part of the winding core and a second part having higher rigidity than the first part. The first electrode and the second electrode are provided on the second part.

According to the preferred embodiment of the present disclosure, the parts of the core on which the electrodes are provided are formed of the second part, which has higher rigidity than the first part, and therefore the entireties of the parts of the core that are in contact with the electrodes (edges of electrodes) can be reinforced by the second part, which has high rigidity and high strength. Therefore, the strength of the parts of the core in contact with the electrodes can be increased, damage (splitting) originating from portions where there is contact between the electrodes and the core can be suppressed and durability of portions of the core to which the electrodes are adhered can be improved.

In addition, in a preferred embodiment, the core is composed of the first part and the second part, the winding core extends along a substantially straight line, and the first flange and the second flange extend in one direction substantially orthogonal to an extension direction of the winding core, the second part includes an end portion of the first flange on one side in the one direction and an end portion of the second flange on the one side in the one direction, the first electrode is provided on a distal part of the end portion of the first flange on the one side in the one direction and the second electrode is provided on a distal part of the end portion of the second flange on the one side in the one direction.

Furthermore, it goes without saying that a case where the core does not include a portion that is not the first part and is not the second part is described by the statement "the core is composed of the first part and the second part".

However, in the present specification, even in the case where the core includes a portion that is not the first part and is not the second part, if this part that is not the first part and is not the second part is just a part for joining the first part and the second part to each other, this case is also assumed to be described by the statement "the core is composed of the first part and the second part".

Here, it is assumed that an adhesive used when bonding the first part and the second part to each other using an adhesive corresponds to the part for joining the first part and the second part to each other.

In addition, in the case where the first part and the second part are fabricated by being simultaneously molded using sintering, a material that readily adheres to both the first part and the second part may be arranged between the first part and the second part, and the first part and the second part may be connected to each other with the readily adhering material acting as an intermediary therebetween. In this case, it is assumed that the readily adhering material corresponds to the part for joining the first part and the second part to each other.

This embodiment is preferable because the first electrode is provided on the distal part of the end portion of the first flange on the one side in the one direction and the second electrode is provided on the distal part of the end portion of the second flange on the one side in the one direction and therefore the electrodes can be easily mounted on a circuit board.

In addition, in a preferred embodiment, the second part includes a part of the first flange located further toward the one side in the one direction than the winding core and a part of the second flange located further toward the one side in the one direction than the winding core.

This embodiment is preferable because a part of each of the flanges located further toward the one side in the one direction than the winding core is formed of the second part and not just the portions of the core to which the electrodes are adhered but rather the entirety of a base portion of the core (base portion of feet of core) located further toward the electrodes side than the winding core is formed of the second part, which has a high strength, and therefore, in addition to it being possible to increase the strength of parts of the core where the electrodes and the core are in contact with each other, it is also possible to increase the strength of the core in the vicinity of boundaries between the winding core and the flanges. Therefore, this embodiment is preferable because in addition to it being possible to suppress damage (splitting) originating from parts where the electrodes and the core are in contact with each other, it is also possible to suppress damage (splitting) originating from the vicinity of boundaries between the winding core and the flanges and to improve the durability of the entire base part of the winding core of the core.

In addition, in a preferred embodiment, the winding core has a central axis parallel to the extension direction of the winding core and the second part includes a part of the core located further toward the one side in the one direction than the central axis.

This embodiment is preferable because a part of the core located further toward the one side in the one direction than the central axis of the winding core is formed of the second part having a high strength, that is, the entirety of the lower half of the core located further toward the electrodes' side than the central axis of the winding core is formed of the second part having high strength and therefore in addition to it being possible to increase the strength of parts of the core where the electrodes and the core are in contact with each other and the strength of the core in the vicinity of boundaries between the winding core and the flanges, it is also possible to increase transverse strength against a force from the top surface side, which is the opposite side to the electrodes' side. Therefore, this embodiment is preferable because the durability of the coil component can be further improved.

In addition, in a preferred embodiment, the first part is composed of the winding core and that the second part is formed of the first flange and the second flange.

This embodiment is preferable because the second part is composed of the first flange and the second flange and therefore the strength in the vicinity of the boundary between the winding core and the first flange can be increased over a wide region and the strength in the vicinity of the boundary between the winding core and the second flange can also be increased over a wide region. Therefore, this embodiment is preferable because the durability of the coil component can be improved.

In addition, in a preferred embodiment, magnetic permeability of the first part is higher than magnetic permeability of the second part.

According to this preferred embodiment, the first part of the core, which has higher magnetic permeability than the second part, includes at least part of the winding core around which the winding is wound and therefore a characteristic of the coil component, for example, a property that increases the inductance by strengthening and enclosing the magnetic field within the coil component can be improved.

According to a coil component of a preferred embodiment of the present disclosure occurrence of damage of a core can be suppressed and durability of the coil component can be improved.

Other features, elements, characteristics and advantages of the present disclosure will become more apparent from the following detailed description of preferred embodiments of the present disclosure with reference to the attached drawings.

DETAILED DESCRIPTION

Hereafter, the present disclosure will be described in detail using illustrated modes.

Figure 1:
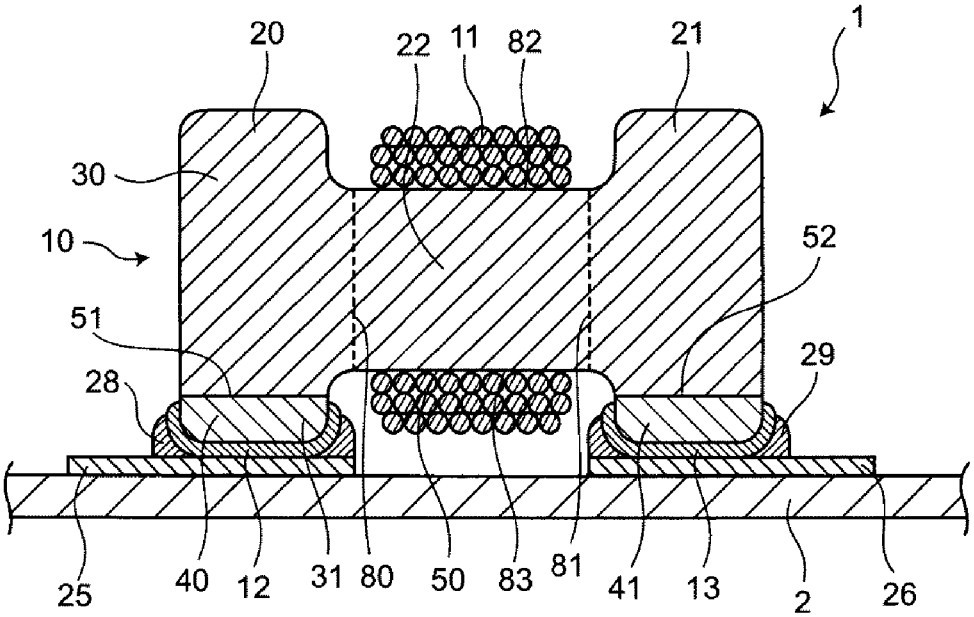
FIG. 1 is a sectional view of a mounting structure in which a coil component of a first embodiment of the present disclosure is mounted on a circuit board.

FIG. 1 is a sectional view of a mounting structure in which a coil component 1 of a first embodiment of the present disclosure is mounted on a circuit board 2.

As illustrated in FIG. 1, the mounting structure includes the coil component 1 and the circuit board 2. The coil component 1 includes a core 10, a winding 11, a first electrode 12 and a second electrode 13, and the core 10 includes a first flange 20, a second flange 21 and a winding core 22. In the plane of FIG. 1, the first flange 20 is located to the left of a dotted line (this dotted line is not visible in reality) 80, the second flange 21 is located to the right of a dotted line 81 (this dotted line is not visible in reality) and the winding core 22 is located between the first flange 20 and the second flange 21 in a left-right direction in the plane of FIG. 1. In the sectional plane of FIG. 1, a substantially straight line 82 indicates an upper boundary of the winding core 22 in the plane of the figure and a substantially straight line 83 parallel to the substantially straight line 82 indicates a lower boundary of the winding core 22 in the plane of the figure.

The winding core 22 has a substantially rectangular parallelepiped shape and extends along a substantially straight line. The first flange 20 has a substantially rectangular parallelepiped shape. In addition, the second flange 21 has substantially the same shape and size as the first flange 20. The core 10 is substantially shaped like the letter H. In more detail, the first flange 20 and the second flange 21 extend in one direction orthogonal to an extension direction of the winding core 22. In addition, the winding core 22 connects a central portion of the first flange 20 in the one direction between the two end portions and a central portion of the second flange 21 in the one direction between the two end portions to each other.

The winding 11 is composed of a metal wire coated with an insulating coating film. For example, a copper wire, a silver wire or a gold wire can be suitably used as the metal wire. The winding 11 is wound around the winding core 22. The first electrode 12 covers the entirety of a distal part of an end portion of the first flange 20 on one side in the one direction. The first electrode 12 is connected to one end of the winding 11 via a lead out wire, which is not illustrated, and is electrically connected to the one end of the winding 11. In addition, the second electrode 13 covers the entirety of a distal part of an end portion of the second flange 21 on the one side in the one direction. The second electrode 13 is connected to the other end of the winding 11 via a lead out wire, which is not illustrated, and is electrically connected to the other end of the winding 11.

As illustrated in FIG. 1, the circuit board 2 has a first land 25 and a second land 26. The first electrode 12 is joined to the first land 25 using solder 28 and the second electrode 13 is joined to the second land 26 using solder 29.

For example, Sn or Pb can be suitably used as the material of the solder 28 and 29 but the material is not limited to this.

In addition, for example Ag can be suitably used as the material of the electrodes 12 and 13 but it is sufficient that the material of the electrodes 12 and 13 be a material having conductivity.

Figure 2:
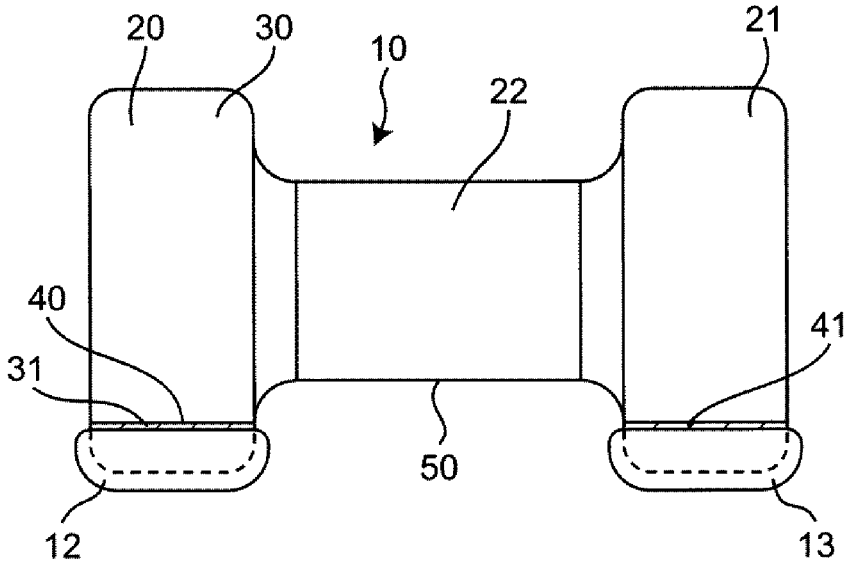
FIG. 2 is a schematic view in which a core provided with first and second electrodes is illustrated three dimensionally.

FIG. 2 is a schematic view in which the core 10 provided with the first and second electrodes 12 and 13 is illustrated three dimensionally. The dotted lines in FIG. 2 indicate the outlines of parts of a second part 31 that, in reality are not visible due to the electrodes 12 and 13.

As illustrated in FIGS. 1 and 2, the core 10 is made up of a first part 30 and the second part 31 and the first part 30 is composed of a ferrite-based material. In more detail, the first part 30 of the core 10 is composed of a Ni—Zn-based ferrite or a Mn—Zn-based ferrite for example. In addition, the second part 31 of the core 10 is composed of aluminum oxide ($Al_2O_3$). The magnetic permeability of the first part 30 is higher than the magnetic permeability of the second part 31 and the rigidity of the first part 30 is lower than the rigidity of the second part 31. The first part 30 and the second part 31 are integrated with each other using the following method. A raw material powder of the ferrite-based material is spread over parts of a metal mold (not illustrated) used to mold the core 10 corresponding to the first part 30 and a raw material powder of aluminum oxide is spread over parts of the metal mold used to mold the core 10 corresponding to the second part 31. After that, compression is performed in an automatic molding machine and then sintering is performed. In this way, the first part 30 and the second part 31 are integrated with each other.

As illustrated in FIG. 1 and FIG. 2, the second part 31 is composed of an end portion 40 of the first flange on the one side in the one direction (one direction orthogonal to extension direction of the winding core 22) and an end portion 41 of the second flange 21 on the one side in the one direction.

As illustrated in FIG. 1 and FIG. 2, the end portions 40 and 41 are located so as to be spaced apart toward the one side in the one direction from a part 50 of the winding core 22 located furthermost toward the one side in the one direction. In the sectional view of FIG. 1, parts 51 and 52 of the end portions 40 and 41 located furthermost toward the winding core 22 side extend substantially parallel to the extension direction of the winding core 22.

As illustrated in FIG. 1 and FIG. 2, the first and second electrodes 12 and 13 are provided on the second part 31. The first and second electrodes 12 and 13 are arranged so as to be spaced apart from the first part 30. The first and second electrodes 12 and 13 cover only the surface of the second part 31 and do not contact the first part 30.

According to the first embodiment, the entireties of the parts of the core 10 that are in contact with the electrodes 12 and 13 are formed of the second part 31, which has high rigidity and high strength, and therefore the strength of the parts of the core 10 that are in contact with the electrodes 12 and 13 can be increased. Therefore, damage (splitting) originating from parts where the electrodes 12 and 13 and the core 10 are in contact with each other can be suppressed and the durability of portions of the core 10 to which the electrodes are adhered can be improved.

Furthermore, according to the first embodiment, the remaining part of the core 10 not covered by the electrodes 12 and 13 is formed of the first part 30 having high magnetic permeability. Here, the part of the core 10 covered by the electrodes 12 and 13 does not contribute to an intrinsic characteristic of the core 10 such as a property that increases the inductance by strengthening and enclosing the magnetic field inside the coil component 1. Therefore, according to the first embodiment, it is possible to improve just the durability of the coil component 1 without reducing the performance of the coil component 1.

In addition, according to the first embodiment, since the first electrode 12 is provided on the distal part of the end portion of the first flange 20 on the one side in the extension direction of the first flange 20 and the second electrode 13 is provided on the distal part of the end portion of the second flange 21 on the one side in the extension direction of the second flange 21, the electrodes 12 and 13 can be easily mounted on the circuit board 2.

Although the first part 30 of the core 10 is for example composed of a Ni—Zn-based ferrite or a Mn—Zn-based ferrite in the first embodiment, the first part of the core in the present disclosure may be formed of another ferrite-based material.

In addition, in the first embodiment, the first part 30 of the core 10 is composed of a ferrite-based material and the second part 31 of the core 10 is composed of aluminum oxide ($Al_2O_3$). However, in the present disclosure, the first part of the core may be formed of a magnetic material other than a ferrite-based material such as an amorphous material, a nanocrystal alloy, a grain oriented silicon steel plate or a permalloy, or may be formed of a non-magnetic material. In addition, the second part of the core may be formed of a material other than an aluminum oxide ($Al_2O_3$) such as a ceramic such as zirconia, silicon carbide or steatite, or a plastic-based material such as epoxy resin or Bakelite. The second part of the core may also be formed of a magnetic material or a non-magnetic material. It is sufficient that the second part of the core be formed of a material having a lower magnetic permeability and a higher rigidity than the first part of the core.

Furthermore, in the first embodiment, the raw material powder that will form the first part 30 and the raw material powder that will form the second part 31 are spread in the metal mold and then subjected to compression and sintering, and thereby the first part 30 and the second part 31 are directly integrated with each other.

However, in the present disclosure, as well as spreading the raw material powder that will form the first part and the raw material powder that will form the second part in a metal mold (not illustrated) used to mold the core, a raw material powder that will readily adhere the first part and the second part to each other may be spread between the raw material powder that will form the first part and the raw material powder that will form the second part, and then compression in an automatic molding machine and sintering may be performed. In this way, the first part and the second part may be indirectly integrated with each other by using a material that will readily adhere the first part and the second part to each other as an intermediary. Thus, even if there is not good affinity for adhesion between the first part and the second part, the first part 30 and the second part 31 can be integrated with each other.

In addition, in the present disclosure, the first part and the second part may be integrated with each other by sticking the first part and the second part to each other using an adhesive after being molded using different metal molds.

Furthermore, in the first embodiment, the electrodes 12 and 13 are connected to the winding 11 via led out wires, but the electrodes may instead be directly connected to ends of the winding in the present disclosure.

Furthermore, in the first embodiment, in the sectional view of FIG. 1, the parts 51 and 52 located furthest toward the winding core 22 in the end portions 40 and 41 in the one direction orthogonal to the extension direction of the winding core 22 extend substantially parallel to the extension direction of the winding core 22. However, in the present disclosure, in the sectional view of the coil component, parts of the end portions of the second part that are located furthermost toward the winding core side in the extension direction of the flanges need not extend parallel to the extension direction of the winding core and for example may extend obliquely with respect to the extension direction of the winding core. That is, in the sectional view of the coil component, parts of the end portions of the second part located furthermost toward the winding core side in the extension direction of the flanges may have any shape other than the shape of a substantially straight line parallel to the extension direction of the winding core and for example may have the shape of a substantially straight line that is not parallel to the extension direction of the winding core, the shape of a curved line that is convex toward the winding core side or the shape of a curved line that is concave toward the winding core side.

Furthermore, in the first embodiment, the winding core 22 has a substantially rectangular parallelepiped shape, but in the present disclosure, the winding core may for example have a polygonal columnar shape other than a rectangular parallelepiped shape or may have a shape other than a polygonal columnar shape such as a substantially circular columnar shape or a substantially elliptical columnar shape. The winding core may have any shape so long as the winding core connects the first flange and the second flange to each other. In addition, in the first embodiment, the winding core 22 extends along a substantially straight line, but in the present disclosure, the winding core need not extend along a substantially straight line and for example may extend along a curved line such as a substantially U-shaped curved line. In this case as well, it goes without saying that there would be a first flange at one end of the substantially U-shaped winding core and a second flange at the other end of the substantially U-shaped winding core.

Furthermore, in the first embodiment, the first flange 20 and the second flange 21 are the same as each other and the flanges 20 and 21 have a substantially rectangular parallelepiped shape. However, in the present disclosure, the first flange and the second flange need not be the same as each other. In addition, in the present disclosure, at least one of the flanges may have a polygonal columnar shape other than a rectangular parallelepiped shape or may have a shape other than a polygonal columnar shape such as a substantially circular columnar shape or elliptical columnar shape. At least one of the flanges may have any shape.

Furthermore, in the first embodiment, the core 10 is substantially H-shaped and the extension direction of the winding core 22 and the extension direction of the flanges 20 and 21 are orthogonal to each other. However, in the present disclosure, the extension direction of the winding core and the extension direction of the flanges need not be orthogonal to each other and for example the two flanges of the core may extend obliquely with respect to each other rather than parallel to each other.

Figure 3:
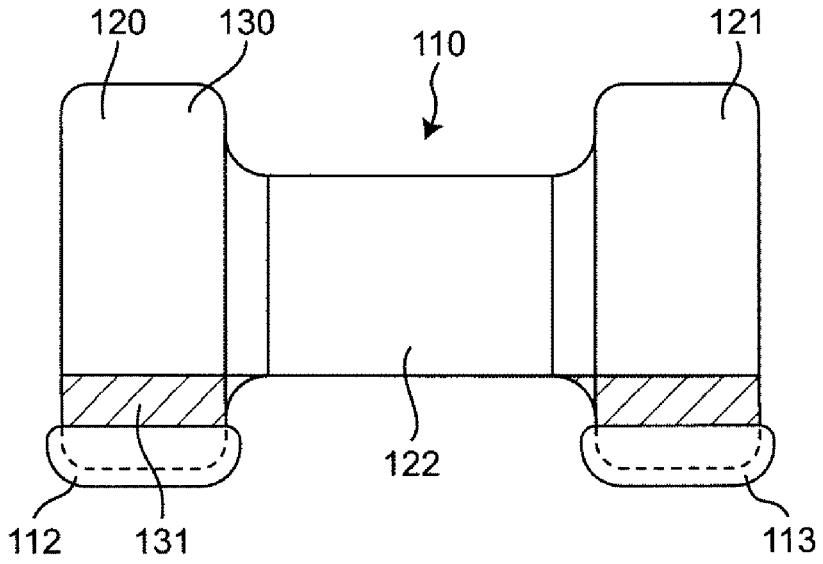
FIG. 3 is a schematic diagram of a coil component of a second embodiment corresponding to FIG. 2.

FIG. 3 is a schematic diagram of a coil component of a second embodiment corresponding to FIG. 2. In the second embodiment, description of parts of the modification that are the same as in the first embodiment is omitted.

The second embodiment differs from the first embodiment in that the region in which a second part 131 is formed is larger than the region in which the second part 31 is formed in the first embodiment.

In more detail, in the second embodiment, as illustrated in FIG. 3, the second part 131 of a core 110 is composed of part of a first flange 120 that is located further toward a first electrode 112 side than a winding core 122 in the extension direction of the first flange 120 and part of a second flange 121 located further toward a second electrode 113 side than the winding core 122 in the extension direction of the second flange 121.

The rest of the configuration of the second embodiment such as for example the core 110 being formed of a first part 130 and the second part 131, the material of the first part 130, the material of the second part 131, the shape of the winding core 122, the shape of the flanges 120 and 121, the winding core 122 extending along a substantially straight line, the first flange 120 and the second flange 121 extending in the one direction orthogonal to the extension direction of the winding core 122 and so forth is the same as in the first embodiment.

According to the second embodiment, a part of each of the flanges 120 and 121 located further toward the electrodes 112 and 113 side in the one direction than the winding core 122 is formed of the second part 131, that is, the entirety of the base part of each of the flanges 120 and 121 located further toward the electrodes 112 and 113 side than the winding core 122 is formed of the second part 131 having a high strength and the region occupied by the second part 131 having a high strength is increased in size up to the vicinity of the boundary between the winding core 122 and the flanges 120 and 121. Therefore, in addition to it being possible to increase the strength of a part of the core 110 that is in contact with the electrodes 112 and 113 similarly to as in the first embodiment, it is further possible in the second embodiment to increase the strength of the core 110 in the vicinity of boundaries between the winding core 122 and the flanges 120 and 121. Therefore, in addition to it being possible to suppress damage (splitting) originating from parts where the electrodes 112 and 113 and the core 110 are in contact with each other, it is also possible to suppress damage (splitting) originating from the vicinity of boundaries between the winding core 122 and the flanges 120 and 121 and to improve the durability of the entire base part of the winding core 122 occupied by the second part 131 in the core 110.

Figure 4:
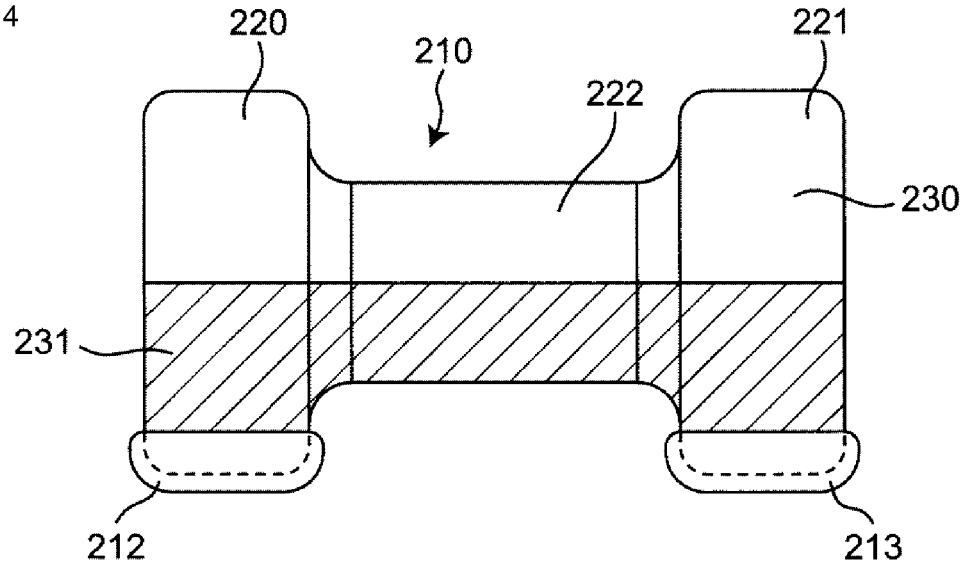
FIG. 4 is a schematic diagram of a coil component of a third embodiment corresponding to FIG. 2.

FIG. 4 is a schematic diagram of a coil component of a third embodiment corresponding to FIG. 2. In the third embodiment, description of parts of the modification that are the same as in the first embodiment is omitted.

The third embodiment differs from the second embodiment in that the region in which a second part 231 is formed is even larger than the region in which the second part 131 is formed in the second embodiment.

In more detail, in the third embodiment as well, a winding core 222 has a substantially rectangular parallelepiped shape, the winding core 222 extends along a substantially straight line and the winding core 222 has a central axis that is parallel to the extension direction of the winding core 222. In addition, a first flange 220 and a second flange 221 extend in one direction orthogonal to the extension direction of the winding core 222. However, in the third embodiment, as illustrated in FIG. 4, the second part 231 is composed of a part of a core 210 that is located further toward an electrodes' 212 and 213 side in the one direction than a central axis. The region occupied by the second part 231 in the third embodiment is larger than the region occupied by the second part 131 in the second embodiment.

The rest of the configuration of the third embodiment such as for example the core 210 being composed of a first part 230 and the second part 231, the material of the first part 230, the material of the second part 231, the shapes of the flanges 220 and 221 and so forth is the same as in the first and second embodiments.

According to the third embodiment, a part of the core 210 located further toward the electrodes 212 and 213 side in the one direction than the central axis of the winding core 222 is formed of the second part 231 having a high strength, that is, the entirety of the core 210 on the electrodes' 212 and 213 side of the central axis of the winding core 222 is formed of the second part 231 having a high strength. Therefore, the region occupied by the second part 231 having a high strength is increased in size up to a part of the core 210 located further toward the electrodes' 212 and 213 side in the one direction than the central axis of the winding core 222 and therefore a force from the top surface side, which is the opposite side to the electrodes 212 and 213 side, can be received by the large second part 231. Therefore, in the coil component of the third embodiment, in addition to it being possible to increase the strength of parts of the core 210 that are in contact with the electrodes' 212 and 213 and increase the strength of the core 210 in the vicinity of boundaries between the winding core 222 and the flanges 220 and 221 similarly to as in the second embodiment, it is also possible in the third embodiment to increase transverse strength against a force from the top surface side, which is the opposite side to the electrodes' 212 and 213 side. Therefore, the durability of the coil component can be further improved.

Figure 5:
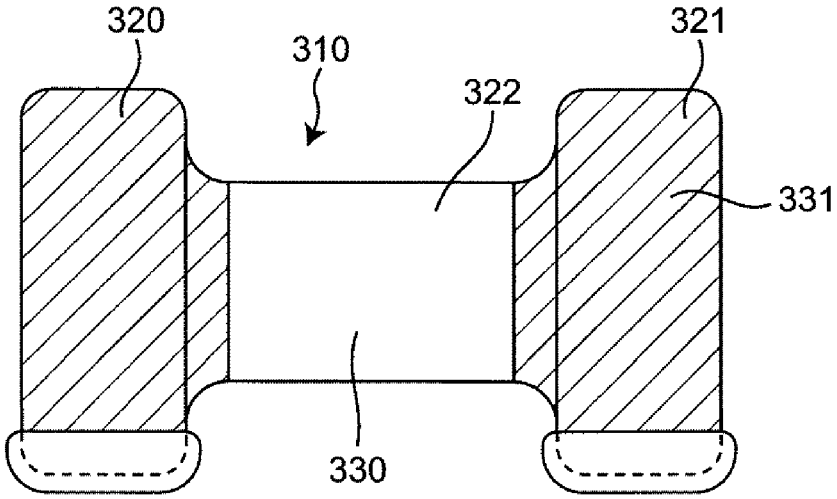
FIG. 5 is a schematic diagram of a coil component of a fourth embodiment corresponding to FIG. 2.

FIG. 5 is a schematic diagram of a coil component of a fourth embodiment corresponding to FIG. 2. In the fourth embodiment, description of parts of the modification that are the same as in the first embodiment is omitted.

As illustrated in FIG. 5, the fourth embodiment differs from the first embodiment in that a first part 330 is formed of a winding core 322 and a second part 331 is formed of a first flange 320 and a second flange 321.

The rest of the configuration of the fourth embodiment such as for example the core 310 being formed of the first part 330 and the second part 331, the material of the first part 330, the material of the second part 331, the shape of the winding core 322, the shape of the flanges 320 and 321, the winding core 322 extending along a substantially straight line, the first flange 320 and the second flange 321 extending in the one direction orthogonal to the extension direction of the winding core 322 and so forth is the same as in the first embodiment.

According to the fourth embodiment, the second part 331 is composed of the first flange 320 and the second flange 321 and therefore the strength in the vicinity of the boundary between the winding core 322 and the first flange 320 can be increased over a wide region and the strength in the vicinity of the boundary between the winding core 322 and the second flange 321 can also be increased over a wide region. Therefore, the durability of the coil component can be improved.

In the first to fourth embodiments, the cores 10, 110, 210 and 310 are formed of the first parts 30, 130, 230 and 330 and the second parts 31, 131, 231 and 331, respectively. However, in the present disclosure, the core may be formed of three or more different materials (the three or more materials are not including a joining material when there is a material for joining together the first part and the second part to each other). In addition, it is of course possible to create a new embodiment by combining two or more configurations from among all of the configurations described in the above embodiments and modifications.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:
a core including a first flange, a second flange and a winding core connecting the first flange and the second flange to each other;
a winding wound around the winding core;
a first electrode provided on the first flange and electrically connected to one end of the winding; and
a second electrode provided on the second flange and electrically connected to another end of the winding;
wherein the core includes a first part including at least part of the winding core and a second part, the second part being formed of a material having higher rigidity than a material of which the first part is formed,
the first electrode and the second electrode are provided on the second part,
the winding core extends along a substantially straight line, and the first flange and the second flange extend in one direction substantially orthogonal to an extension direction of the winding core,
the second part includes an end portion of the first flange on one side in the one direction and an end portion of the second flange on the one side in the one direction, and
a boundary between the first part and the second part is located in the one side from the winding core and spaced from the winding core in the one direction.

2. The coil component according to claim 1,
wherein magnetic permeability of the first part is higher than magnetic permeability of the second part.

3. The coil component according to claim 1, wherein the first part is formed of ferrite-based material.

4. The coil component according to claim 1, wherein the first part is formed of amorphous material or a nanocrystal alloy.

5. A coil component comprising:
a core including a first flange, a second flange and a winding core connecting the first flange and the second flange to each other;
a winding wound around the winding core;
a first electrode provided on the first flange and electrically connected to one end of the winding; and
a second electrode provided on the second flange and electrically connected to another end of the winding;
wherein the core includes a first part including at least part of the winding core and a second part, the second part being formed of a material having higher rigidity than a material of which the first part is formed,
the first electrode and the second electrode are provided on the second part,
the first part is composed of the winding core and the second part includes the entirety of one of the first flange and the second flange, and
a boundary between the first part and the second part extends along a direction substantially orthogonal to an extension direction of the winding core from the first flange to the second flange.

6. The coil component according to claim 5,
wherein magnetic permeability of the first part is higher than magnetic permeability of the second part.

7. The coil component according to claim 5, wherein the first part is formed of ferrite-based material.

8. The coil component according to claim 5, wherein the first part is formed of amorphous material or a nanocrystal alloy.

* * * * *